US010702914B2

(12) United States Patent
Fujikawa

(10) Patent No.: US 10,702,914 B2
(45) Date of Patent: Jul. 7, 2020

(54) LIGHT METAL INJECTION MOLDING MACHINE

(71) Applicant: Sodick Co., Ltd., Kanagawa (JP)

(72) Inventor: Misao Fujikawa, Kanagawa (JP)

(73) Assignee: SODICK CO., LTD., Kanagawa (JP)

( * ) Notice: Subject to any disclaimer, the term of this patent is extended or adjusted under 35 U.S.C. 154(b) by 96 days.

(21) Appl. No.: 16/111,226

(22) Filed: Aug. 24, 2018

(65) Prior Publication Data

US 2019/0060987 A1 Feb. 28, 2019

(30) Foreign Application Priority Data

Aug. 25, 2017 (JP) ..... 2017-162364

(51) Int. Cl.
*B22D 17/20* (2006.01)
*B22D 17/04* (2006.01)

(52) U.S. Cl.
CPC ..... *B22D 17/203* (2013.01); *B22D 17/04* (2013.01)

(58) Field of Classification Search
CPC ..... B22D 17/04; B22D 17/20; B22D 17/203
USPC ..... 164/303, 312, 316, 900
See application file for complete search history.

(56) References Cited

U.S. PATENT DOCUMENTS 7,225,855 B2 * 6/2007 Miyazaki et al. ..... B22D 17/04 164/113
2005/0056978 A1 3/2005 Fujikawa
2007/0023159 A1 * 2/2007 Taniguchi ..... B22D 17/00 164/113

FOREIGN PATENT DOCUMENTS

JP 2007268542 10/2007
WO 2004018130 3/2004

* cited by examiner

*Primary Examiner* — Kevin P Kerns
(74) *Attorney, Agent, or Firm* — JCIPRNET

(57) ABSTRACT

A light metal injection molding machine includes an injection cylinder, a seal cylinder, a plunger, and a seal mechanism having a first annular body, a second annular body and a third annular body. The first annular body is arranged in an opening of the seal cylinder, and maintains a semisolid state of a molding material in a first gap between its inner periphery surface and the plunger. The second annular body is arranged in the opening between the injection cylinder and the first annular body, and includes an anterior internal groove formed over its whole inner periphery surface and a plurality of anterior transverse holes passing through the inner periphery surface. The third annular body is accommodated into the anterior internal groove transformably in a radial direction of the plunger, and tighten the plunger by pressurization from molding material flowing into the anterior transverse holes.

14 Claims, 2 Drawing Sheets

LIGHT METAL INJECTION MOLDING MACHINE

CROSS-REFERENCE TO RELATED APPLICATIONS

This application claims the priority benefit of Japanese Patent Application No. 2017-162364, filed on Aug. 25, 2017. The entirety of the above-mentioned patent application is hereby incorporated by reference herein and made a part of this specification.

BACKGROUND OF THE INVENTION

Technical Field

The disclosure relates to a light metal injection molding machine that injects a molding material made of a light metal by a plunger. In particular, the disclosure relates to a light metal injection molding machine including a seal mechanism for a plunger that seals by a molding material itself.

Related Art

An injection molding machine is known that pushes a molding material supplied to an injection cylinder by a plunger, and injects the molding material into a cavity space of a mold. A nozzle is arranged on a front side of the injection cylinder and a seal cylinder with an opening is arranged on a back side of the injection cylinder. The plunger is arranged to pass through the opening, and reciprocates by moving forward and backward repeatedly along a central axis of the injection cylinder.

A tiny gap between an inner periphery surface of the injection cylinder and an outer periphery surface of the plunger is required to make the plunger move smoothly. The molding material supplied into the injection cylinder has fluidity in a molten state. Therefore, when the plunger moves forward, the molding material filled in an injection chamber which is formed in the injection cylinder is compressed. Then, the molding material is pushed to the gap between the injection cylinder and the plunger. The molding material may reach the opening that the plunger passed through. A seal arranged between the opening and the plunger prevents the molding material from leaking out of the injection cylinder.

When the molding material is a light metal such as an aluminium alloy, the molten light metal has a lower viscosity and a higher fluidity compared with a molten resin, so that the molding material permeates easily between the seal and the plunger. Therefore, it is hard to seal the opening by a general packing such as an O-ring. When the leak protection of the seal is improved, the sealing resistance increases and the required slidability of the plunger may not be ensured.

Japanese Laid-open No. 2007/268542 discloses a light metal injection molding machine having a seal mechanism for a plunger, which is formed by arranging a pair of annular seals having a right triangle cross-section between an outer periphery surface of the plunger and an inner periphery surface of a cylinder. The pair of integrated annular seals transforms in a radial direction due to a pressure of a molding material which is a molten light metal and is flowed into the seals. The transformation of the seals prevent the outflow of the molding material. The invention of patent Japanese Laid-open No. 2007/268542 may also adjust a temperature of the molding material by a heater and a cooling channel to prevent the solidification of the molding material.

International Publication No. WO 2004/18130 discloses a light metal injection molding machine with an annular groove formed on an inner periphery of an injection cylinder or an outer periphery of a plunger. The molding material which is a molten light metal that flows from an injection chamber to an outer periphery surface of the plunger is introduced into the annular groove. The molding material itself seals the plunger by cooling the molding material in the annular groove to a prescribed temperature and maintaining the so-called semisolid state, that is, a state between liquid and solid.

In recent years, some molding products require advanced molding conditions in injection molding. For example, a requirement on thinning a molding products made of a light metal is increasing. The thinner a wall thickness of molding products is, the faster a required injection speed is, and a peak pressure of the injection pressure tends to increase. When the peak pressure increases, a pressure from a molding material in an injection chamber also increases, a load exerted on a seal mechanism for a plunger from the molding material flowing to the back side of an injection cylinder also increases.

In a case that a pair of annular seals is shifted from each other in a circumferential direction of the plunger and the seal is transformed as a whole by the pressure exerted from the flowing direction of the molding material, designingly, it is difficult to properly adjust the force for tightening the plunger via the seal because of a limitation on design. Substantively, the seals may not be manufactured so as to satisfy both of the leak protection and the slidability of the plunger in accordance with features of the molding material. Accordingly, the higher the peak pressure of the injection pressure is, the more difficult it is to prevent the leakage of the molding material, and a smooth movement of the plunger will also be obstructed.

In a case of leak protection by the semisolid molding material, resistance to load is limited. The leak protection may be improved by further reducing the temperature around the gap between the injection cylinder and the plunger to decrease the fluidity of the molding material flowing to the back-end side of the injection cylinder. However, it is extremely difficult to manage the temperature, and there is concern that the molding material is solidified and prevents the plunger from moving.

SUMMARY

The disclosure provides a light metal injection molding machine, which includes a seal mechanism of a plunger which seals by a molding material itself made of a light metal; the seal mechanism is an improved seal mechanism which can ensure a smooth movement of the plunger and prevent a leakage of the molding material properly in an injection molding in which the peak pressure of the injection pressure is relatively large. In the description of the embodiment of the invention, the advantages that can be obtained through the invention are specified.

The light metal injection molding machine of an embodiment of the disclosure, includes: an injection cylinder having an injection chamber filled with a molding material made of a light metal, a seal cylinder having an opening, a plunger which passes through the opening, reciprocates in the injection chamber and injects the molding material, and a seal mechanism, which prevents a leakage of the molding material between the opening and the plunger, wherein the seal mechanism includes: a first annular body which is arranged in the opening, forms a first gap between an inner periphery surface and an outer periphery surface of the plunger, and maintains a semisolid state of the molding material in the first gap, a second annular body, which is sandwiched between the injection cylinder and the first annular body along a moving direction of the plunger to be arranged in the opening, so that lateral surfaces of the first annular body and the second annular body contact with each other, and which includes an anterior internal groove which is formed over a whole inner periphery surface of the second annular body, and a plurality of anterior transverse holes passing through the inner periphery surface of the second annular body in a direction perpendicular to the anterior internal groove, and a third annular body, at least a part of which is accommodated into the anterior internal groove transformably in a radial direction of the plunger, and which is pressurized by the molding material flowing into the anterior transverse holes to reduce diameter equally on the whole and tighten the plunger.

DESCRIPTION OF THE EMBODIMENTS

Figure 1:
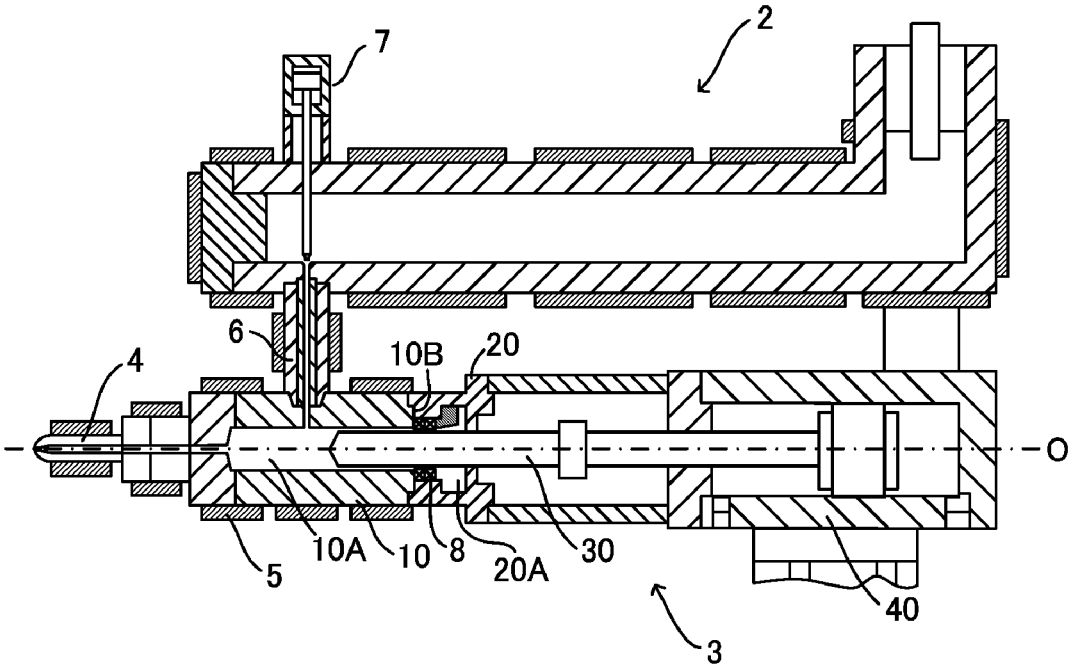
FIG. 1 is a drawing showing an outline of a light metal injection molding machine of the disclosure.

FIG. 1 shows an embodiment in which a light metal injection molding machine of the disclosure is applied. FIG. 1 shows a melting unit 2 and an injection unit 3 which includes and an injection cylinder 10 in a cross section. In FIG. 1, on one side of a longitudinal direction of the injection cylinder 10 on which a nozzle 4 is arranged is set as a front-end side of the injection cylinder 10. In other words, a left side of the drawing is set as the front-end side of the injection cylinder 10. A right side of the drawing is set as a back-end side. In addition, a front side of the drawing is set as a front surface of the injection molding machine, and an opposite side is set as a rear surface.

The light metal injection molding machine mainly includes the melting unit 2, the injection unit 3, and a mold clamping device which is not illustrated. The melting unit 2 may use various structures as long as it is capable of melting a molding material, not limited to the structure shown in FIG. 1.

A seal cylinder 20 having an opening 20A is arranged in the back-end side of the injection cylinder 10. The seal cylinder 20 is coaxially provided with the injection cylinder 10. The opening 20A has a function as an entrance, for inserting a plunger 30 into the injection cylinder 10 and mounting the plunger 30 in a way that the plunger 30 may reciprocate. That is, the light metal injection molding machine of the disclosure injects the molding material by the plunger 30 which is arranged to pass through the opening 20A and reciprocates along a central axis of the injection cylinder 10. In addition, the injection cylinder 10 and the seal cylinder 20 may be configured, integrated with each other or separated from each other.

In the disclosure, a light metal refers to a metal with a specific gravity of 4.5 or less than, or an alloy taking the metal as the main composition. In particular, as an appropriate light metal for the molding material, for example, a copper-containing aluminium alloy for die casting which is specified as ADC12 in Japanese Industrial Specifications, or an aluminium-containing magnesium alloy for die casting which is specified as AZ91D in Japanese Industrial Specifications is known. In addition, according to the structure of the melting unit 2, various kinds of shapes such as ingot, billet and chip can be used for the molding material.

The light metal injection molding machine includes a nozzle 4, a plurality of band heaters 5 and a junction 6. The nozzle 4 is arranged on the front-end side of the injection cylinder 10. The plurality of band heaters 5, as shown in FIG. 1, are arranged respectively with a necessary number on the melting unit 2, the nozzle 4, the junction 6 and the injection cylinder 10. The junction 6 connects the melting unit 2 to the injection cylinder 10.

A molding material melted by the melting unit 2 is sent into an injection chamber 10A of the injection cylinder 10 through the junction 6. When the molten molding material is injected, a flow path of the junction 6 is blocked by a backflow preventing device 7. The backflow preventing device 7 is arranged, for example, on the melting unit 2, and may also be arranged on the junction 6 or the injection unit 3. Accordingly, when the plunger 30 moves forward, the injection chamber 10A reduces, and the molten molding material supplied into the injection chamber 10A is compressed. Thus, most of the molding material is injected from the nozzle 4. At this time, few of the molding material flows to a gap between an inner periphery surface of the injection cylinder 10 and an outer periphery surface of the plunger 30, and is pushed to the back-end side of the injection cylinder 10.

The injection unit 3 includes the injection cylinder 10, the seal cylinder 20, the plunger 30, and a driving device 40. The driving device 40 is, for example, a means for making the plunger 30 move along the central axis O of the injection cylinder 10 through a double-acting hydraulic cylinder. On the front-end side of the injection cylinder 10, the injection chamber 10A is formed by the plunger 30. On the back-end side of the injection cylinder 10, the seal cylinder 20 having the opening 20A is arranged. The plunger 30 is arranged to pass through the opening 20A.

The injection unit 3 includes a seal mechanism 8 for the plunger 30. Basically, the seal mechanism 8, seals the gap between the opening 20A and the plunger 30 by making the molding material, which is made of a light metal in the semisolid state, intervene in a gap between the inner periphery surface of an annular seal 8A arranged on the opening 20A and the outer periphery surface of the plunger 30.

In the disclosure, a semisolid state refers to a transition state before the molten liquid metal is congealed and transferred to a solidified state in a process of cooling within an inherent prescribed temperature range of the metal, wherein a viscosity is generated and a mobility is low compared with a liquid state. As the prescribed temperature range to the semisolid state, for example, it is about 515° C.-582° C. in the case of the aluminium alloy ADC12, and it is about 468° C.-598° C. in the case of the magnesium alloy AZ91D.

In particular, as for the seal mechanism 8 of the invention, as the plunger 30 moves forward and an injection pressure increases during the injection, the annular seal 8A transforms to reduce diameter equally on the whole and tighten the plunger 30. In a general molding condition, the injection pressure reaches a peak pressure just before and after a VP switching that the driving of the plunger 30 switches from a speed control to a pressure control. Accordingly, when the injection pressure is above a prescribed value, preferably only within a short prescribed duration just before and after the VP switching, the annular seal 8A transforms and the plunger 30 is tightened. In this way, the gap between the inner periphery surface of the annular seal 8A and the outer periphery surface of the plunger 30 is filled, and the space between the opening 20A and the plunger 30 is sealed.

Figure 2:
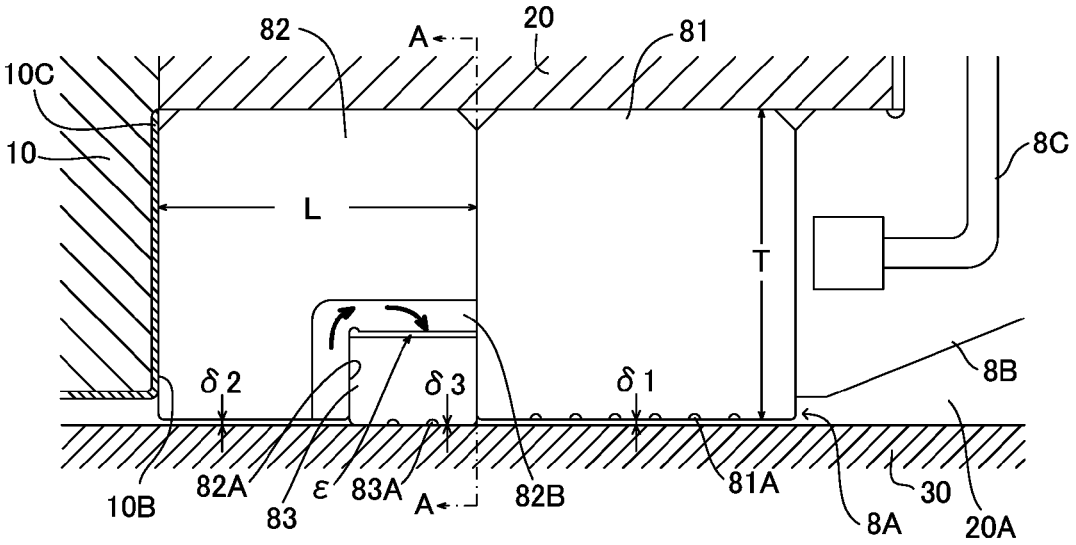
FIG. 2 is a drawing showing a seal mechanism of a plunger for the light metal injection molding machine of the disclosure.
Figure 3:
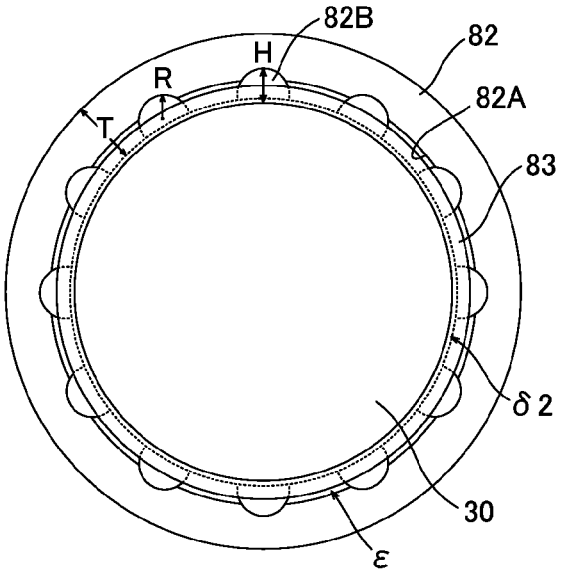
FIG. 3 is a cross-sectional view of the seal mechanism in FIG. 2.

FIG. 2 shows an embodiment in which the seal mechanism 8 of the invention is suitably applied. FIG. 2 shows a cross-section on an upper side when the seal mechanism 8 observed from a front surface of the injection molding machine is cut vertically along a central axis O of the injection cylinder 10. FIG. 3 shows an A-A cross section of the annular seal 8A observed from a back-end direction of the injection cylinder 10 shown in FIG. 2.

The seal mechanism 8 of the embodiment shown in FIG. 2 includes the annular seal 8A and a pressing body 8B. The annular seal 8A includes a first annular body 81, a second annular body 82, and a third annular body 83. In the first annular body 81, the second annular body 82, and the third annular body 83 of the disclosure, an exterior surface, that is, a surface opposing the seal cylinder 20 is called an outer periphery surface, an interior surface, that is, a surface opposing the plunger 30 is called an inner periphery surface, and end surfaces in a horizontal direction in FIG. 2 are called lateral surfaces. Besides, in the first annular body 81, the second annular body 82 and the third annular body 83 in FIG. 2, a length in the horizontal direction is called width and a length in the vertical direction is called thickness.

The annular seal 8A of the embodiment has a seal function for preventing a leakage between the opening 20A and the plunger 30, and has a guide function for guiding a smooth movement of the plunger 30, mainly by the first annular body 81 and the third annular body 83.

The pressing body 8B tightens the annular seal 8A which includes the first annular body 81, the second annular body 82 and the third annular body 83, by pressing the annular seal 8A to a contact surface 10B of the injection cylinder 10, and fixes the annular seal 8A in the opening 20A. Inside the pressing body 8B, a flow path 8C of the cooling medium in a temperature management system having a cooling device not illustrated is formed. The pressing body 8B is actually set as a cooling body for cooling the first annular body 81 to a prescribed temperature range, and maintaining the molding material in a first gap 61 described below to the semi solidified state. Air or other gases are suitable for the cooling medium because of a high temperature of a cooling part.

The first annular body 81 is arranged in the opening 20A. The first gap δ1 is formed between the inner periphery surface of the first annular body 81 and the outer periphery surface of the plunger 30. The first annular body 81 substantively seals the gap between the opening 20A and the plunger 30 by maintaining the molding material made of the light metal in the first gap δ1 to the semisolid state.

The first annular body 81 is arranged so that the lateral surface closely contacts with one lateral surface of the pressing body 8B, and is cooled by the pressing body 8B. Therefore, in the first gap δ1, the temperature of the molding material can be reduced to a prescribed temperature range in a relatively short duration. As a result, the molding material in the first gap δ1 is maintained in the semisolid state. The proper prescribed temperature range that can maintain a semisolid state corresponding to the type of the molding material is as described above.

The appropriate size of the first gap δ1 depends mainly on a type and a volume of the molding material and a cooling method. Generally, in a case that the first annular body 81 is cooled by the pressing body 8B, the first gap δ1 is easily damaged when the size of the first gap δ1 is equal to or more than 0.10 mm. On the other hand, the molding material in the first gap δ1 is easily solidified when the size of the first gap δ1 is less than 1 μm. Thus, the size of the first gap δ1 is suitably 0.03 mm-0.06 mm. In the case of the annular seal 8A of the embodiment, the width of the first annular body 81 is 16 mm, and the size of the first gap δ1 is 0.05 mm.

On the inner periphery surface of the first annular body 81, a labyrinth 81A is formed. The labyrinth 81A has a plurality of grooves which are arranged at predetermined intervals along the direction of the central axis O of the injection cylinder 10 on the first annular body 81. Similar to a general labyrinth seal set on a bearing, the labyrinth 81A improves the leak protection by increasing a pressure loss of the molding material which intervenes in the first gap δ1, and reduces a friction between the first annular body 81 and the plunger 30.

The first annular body 81 is desirably made of a material that is not melted by the molding material, such as heat-resistant zirconia ceramics to which oxides are added, that is, stabilized zirconia. The first annular body 81 can be made of metal as long as the surface is treated to protect against the molding material; for example, the first annular body 81 can be made of the same material as the plunger 30. In addition, the whole interior surface of the injection cylinder 10 including the inner periphery surface is covered by a sprayed layer 10C having a cermet surface so as to be protected from being melted by the molding material which is the molten light metal.

The second annular body 82 is arranged in a coaxial direction with the central axis O of the injection cylinder 10, so that lateral surfaces of the second annular body 82 and the first annular body 81 contact with each other. In other words, the second annular body 82 is sandwiched between the injection cylinder 10 and the first annular body 81 along the moving direction of the plunger 30, and is arranged side by side with the first annular body 81 to the opening 20A. Similar to the first annular body 81, the material of the second annular body 82 is heat-resistant zirconia ceramics for example.

In the inner periphery surface of the second annular body 82, an anterior internal groove 82A is formed over the entire periphery. Besides, a plurality of anterior transverse holes 82B in the same shape are passing through the inner periphery surface of the second annular body 82, in a direction perpendicular to the anterior internal groove 82A, in other words, in the moving direction of the plunger 30. In the second annular body 82 of the embodiment shown in FIG. 2, twelve anterior transverse holes 82B are arranged to be placed equally on the circumference, observed from a lateral surface on the first annular body 81 side.

A plurality of band heaters 5 heat the injection cylinder 10 to a temperature which maintains the molten state of the molding material in the injection cylinder 10. The heat of the injection cylinder 10 is transferred to the second annular body 82 which contacts with the injection cylinder 10. Besides, the second annular body 82 is arranged to contact closely with the first annular body 81 which is cooled by the pressing body 8B, and the second annular body 82 is thus cooled indirectly through the first annular 81.

As a result, a temperature of the molten molding material, which flows into the anterior transverse holes 82B through a second gap δ2 between the inner periphery surface of the second annular body 82 and the outer periphery surface of the plunger 30, is lower than a temperature of the molten molding material in the gap between the injection cylinder 10 and the plunger 30, and is higher than a temperature of the molding material in the semisolid state in the first gap δ1. Therefore, the molten molding material which flows to the anterior transverse holes 82B from the second gap δ2 easily transfers to the semisolid state.

The second annular body 82 positions and keeps the third annular body 83. The second annular body 82 presses and transforms the third annular body 83 so that the third annular body 83 shrinks in a radial direction of the plunger 30. Accordingly, the second annular body 82 does not have a function for directly sealing the gap between the opening 20A and the plunger 30.

The size of the second gap δ2 affects greatness of the sealing resistance and an amount of the molten molding material which leaks from a third gap δ3 that may be formed between the third annular body 83 and the plunger 30. The smaller the second gap δ2 is, the greater a pressure drop of the molding material in the second gap δ2 is, thus an applied pressure which is applied to the third annular body 83 from the molding material in the anterior transverse holes 82B becomes smaller. As a result, although a tightening force that is applied to the plunger 30 from the third annular body 83 becomes smaller and the amount of the molding material which leaks in the third gap δ3 relatively increases, the sealing resistance becomes smaller.

Accordingly, it is favourable that the size of the second gap δ2 is reduced as much as possible to decrease the sealing resistance, in a range that the sealing of the semisolid molding material in the first gap δ1 is not broken by the molten molding material which leaks from the third gap δ3. Specifically, FIG. 2 shows, when a diameter of the plunger 30 is 90 mm, the second annular body 82 with an inner diameter in which the second gap δ2 is 0.05 mm and the third annular body 83 with a width of 7 mm. Accordingly, it is favourable in that the seal mechanism 8 of the embodiment is relatively easily designed and manufactured. In addition, although the seal mechanism 8 may be configured so that the second gap δ2 is not arranged and the molding material directly flows into the anterior internal groove 82A from the gap between the injection cylinder 10 and the plunger 30, preferably, the second gap δ2 with a prescribed size is arranged according to the above reasons.

In the seal mechanism 8, the annular seal 8A can be replaced. Therefore, for example, a set of a second annular body 82 with an inner diameter in which the second gap δ2 is 0.05 mm and a third annular body 83 with a width of 7 mm, and a set of a second annular body 82 with an inner diameter in which the second gap δ2 is 0.10 mm and a third annular body 83 with a width of 6 mm can be prepared in advance.

The third annular body 83 is accommodated into the anterior internal groove 82A of the second annular body 82, transformably in the radial direction of the plunger 30. The third annular body 83 seals only when the injection pressure is greater than the prescribed value, in particular, within a prescribed short duration including the period when the injection pressure reaches a peak pressure. That is, the molten molding material that flows into the plurality of anterior transverse holes 82B pressurizes the third annular body 83 in the radial direction. The plurality of anterior transverse holes 82B are arranged equally on the circumference of the inner periphery surface of the second annular body 82, observed from the lateral surface. Thus, the third annular body 83 reduces diameter equally on the whole and tightens the plunger 30.

When the injection pressure is smaller than the prescribed value, the molten molding material in the anterior transverse holes 82B of the second annular body 82 cannot transform the third annular body 83, so that the third annular body 83 contacts with the outer periphery surface of the plunger 30 in appearance. Accordingly, the third annular body 83 contacts with the sliding surface and transforms with respect to the sliding surface; therefore, structurally, the third annular body 83 can be regarded as a mechanical seal.

The third annular body 83 is arranged in the opening 20A so as to be sandwiched, by the first annular body 81 which is pushed to the direction of the contact surface 10B of the injection cylinder 10 by the pressing body 8B, between the injection cylinder 10 and the first annular 81 along with the second annular body 82. Therefore, the third annular body 83 is regulated so as not to move in the moving direction of the plunger 30 between the lateral surface of the first annular body 81 and the lateral surface of the anterior internal groove 82A of the second annular body 82, and the molding material is prevented from leaking out of the lateral surface of the third annular body 83.

The third annular body 83 is made of a material which is not melted by the molten light metal molding material and has a flexibility capable of transforming so as to expand or reduce in the radial direction of the plunger 30 by a prescribed length set depending on the diameter of the plunger 30. For example, the desirable amount of the prescribed length is increased about 2 μm-3 μm for every centimeter of the diameter of the plunger 30. In particular, in order to stabilize the tightening force of the third annular body 83, the materials of the third annular body 83 and the plunger 30 are desirably the same, or at least are materials by which the thermal expansion coefficient of the third annular body 83 is almost the same as the thermal expansion coefficient of the plunger 30.

Specifically, for example, when the third annular body 83 is made of silicon carbide ceramics, the plunger 30 is also made of silicon carbide ceramics. Besides, for example, when the third annular 83 is made of a material in which a steel is covered by stabilized zirconia, the plunger 30 is also made of the same material.

The anterior internal groove 82A of the second annular body 82 is formed deeper than the thickness of the third annular body 83. Therefore, a fourth gap ε is formed between the inner periphery surface of a part of the second annular body 82 on which the anterior internal groove 82A is arranged and the outer periphery surface of the third annular body 83. The fourth gap ε allows the third annular body 83 to transform in the radial direction of the plunger 30, and regulates the maximum expansion to prevent the breakage of the third annular body 83. The fourth gap ε is suitably 0.06 mm for example.

The third annular body 83 is formed so that the inner diameter is slightly smaller than the diameter of the plunger 30. The amount of the inner diameter of the third annular body 83 is smaller by about 2 μm-3 μm for every centimeter of the diameter of the plunger 30. In the seal mechanism 8 of the embodiment, for example, when the diameter of the plunger 30 is 90 mm, the inner diameter of the third annular body 83 is 20 μm smaller than 90 mm. Accordingly, when the third annular body 83 is mounted on the opening 20A, the third annular body 83 is transformed to expand a little from an initial shape and is fitted to the plunger 30.

When the third annular body 83 with a width of 7 mm and a thickness of 4 mm is fitted to the plunger 30 with a diameter of 90 mm by an interference fit of 20 μm, the tightening force in the initial shape of the third annular body is, converted with reference to Young's modulus of iron, 760 kgf on the whole and the load applied to the plunger 30 by the sliding resistance is about 230 kgf. The numerical value indicates the sliding resistance does not hinder the movement of the plunger 30 in the absence of the molding material.

The molding material made of the molten light metal has a substantially lower viscosity and a significantly higher fluidity compared with a molten resin, and thus enters and permeates gradually into the space between the third annular body 83 and the plunger 30, expanding the diameter of the third annular body 83 which is transformable and has flexibility. In particular, the phenomenon is remarkable when the molding material is aluminium alloys with an especially low viscosity.

When the third annular body 83 is expanded a little by the molding material which permeates between the inner periphery surface of the third annular body 83 and the outer periphery surface of the plunger 30, the third gap δ3 caused by a thin-film of the molding material is formed between the third annular body 83 and the plunger 30, and the molding material flows in the third gap δ3. The thin-film of the molten molding material in the third gap δ3 reduces the sealing resistance in the third gap δ3, and improves the slidability of the plunger 30.

In the third annular body 83, a labyrinth 83A which is the same as the first annular body 81 is formed, so that a pressure loss is generated in the molding material in the third gap δ3, and the molten molding material of the third gap δ3 does not damage the sealing formed by the semisolid molding material in the first gap δ1.

When the injection pressure increases, the pressure of the molding material that flows into the plurality of anterior transverse holes 82B formed in the second annular body 82 also increases, and the third annular body 83 is pressurized from the outer periphery surface side in the radial direction of the plunger 30. The plurality of anterior transverse holes 82B are arranged equally on the lateral surface of the second annular body 82, so that the entire third annular body 83 transforms to shrink equally in the radial direction of the plunger 30. As a result, the third annular body 83 tightens the plunger by a tightening force corresponding to the applied pressure of the molding material in the anterior transverse holes 82B.

The size of each annular body in the annular seal 8A of the seal mechanism 8 of the embodiment is determined properly based on the diameter of the plunger 30, the material of each annular body and so on. As for the annular seal 8A of the embodiment shown in FIG. 2 and FIG. 3, specifically, the first gap δ1 and the second gap δ2 are designed to be 0.05 mm. The width L of the first annular body 81 and the second annular body 82 is set to 16 mm. The thickness T of the first annular body 81 and the second annular body 82 is set to 15 mm. A height H of the anterior transverse holes 82B is set to 6 mm. A radius R of the curved surface on the bottom side of the anterior transverse holes 82B is set to 4 mm. The width of the third annular body 83 is set to 7 mm. The thickness of the third annular body 83 is set to 4 mm.

Next, an operation of the steel mechanism 8 in the light metal injection molding machine of the invention is described. The operation is performed in such a state that the molten molding material has already been supplied from the melting unit 2, and the molding material reaches the annular seal 8A through the tiny gap between the injection cylinder 10 and the plunger 30.

In the first gap δ1, while the light metal injection molding machine is at work, the cooling medium is continuously supplied to the flow path 8C of the pressing body 8B, and the molding material is cooled to the prescribed temperature range to maintain the semisolid state. In the second gap δ2 and the anterior transverse holes 82B, the molding material which is heated by the heat delivered from the injection cylinder 10 is flowing.

The first annular body 81 and the second annular body 82 are arranged so that the lateral surfaces of the second annular body 82 and the first annular body 81 contact closely with each other; therefore, the temperature of the molding material in the second gap δ2 is lower than the temperature of the molding material in the injection cylinder 10, and is higher than the temperature of the semisolid molding material in the first gap δ1. That is, the molding material flows to the first gap δ1 with the temperature decreasing in stages, so that the molding material is easily transferred to the semisolid state in the first gap δ1. Therefore, the seal mechanism 8 in the embodiment is that the temperature management of the sealing is relatively easy. In particular, the seal mechanism 8 is effective when the molding materials are aluminium and aluminium alloys for which the prescribed temperature range for the semisolid state is narrower than the prescribed temperature range of magnesium and magnesium alloys.

Although the inner periphery surface of the third annular body 83 and the outer periphery surface of the plunger 30 contact completely with each other at first without a gap between the two, the molding material made of the light metal with a low viscosity permeates gradually the space between the third annular body 83 and the plunger 30, and makes the third annular body 83 transform to expand the third annular body 83. As a result, the third gap δ3 is formed between the third annular body 83 and the plunger 30.

Regarding to the molten molding material which intervenes in the third gap δ3, the pressure decreases due to the labyrinth 83A so that the leakage is prevented easily by the semisolid molding material in the first gap δ1. The molding material which intervenes in the third gap δ3 forms a thin-film to reduce the sealing resistance, so that the slidability of the plunger 30 is improved and the movement of the plunger 30 becomes smooth. In particular, when the molding material is aluminium or aluminium alloys with a low viscosity, the decrease of the sealing resistance causes a remarkable increase of the slidability. Therefore, the seal mechanism 8 prevents the leakage properly, and reduces the wear of the sealing and the loss of the energy.

In an injection process, after the plunger 30 was made to move forward and a cavity space of a mold was filled with most of the molding material, the prescribed pressure is applied by the plunger 30 to keep the pressure, the remaining molding material is pushed in and the quality of a molding product is stabilized. When the molding material is filled, the pressure of the molding material in the injection chamber 10A is still low, and the load to the annular seal 8A is also small. Therefore, even if the sealing resistance in the annular seal 8A is small, the leakage of the molding material is prevented absolutely; moreover, a high-speed movement of the plunger 30 is not interrupted.

As the molding material is filled in the mold, the pressure of the molding material in the injection chamber 10A also increases. In particular, when the injection pressure almost reaches the peak pressure, the pressure of the molding material in the injection chamber 10A also increases rapidly.

At this time, there is a possibility that a flow rate of the molding material which flows to the back-end side of the injection cylinder 10 from the injection chamber 10A increases, and the pressure of the molding material in the second gap δ2 exceeds a limit of tolerance of the semisolid molding material which intervenes in the first gap δ1.

The molten molding material which intervenes in the second gap δ2 intends to flow equally into the plurality of anterior transverse holes 82B which are arranged equally on the inner periphery surface of the second annular body 82 along the circumference, so that the pressure of the molding material in the anterior transverse holes 82B also increases, and the annular body 83 is pressurized in a direction in which the diameter is reduced. The third annular body 83 tightens the plunger 30 by a strong tightening force corresponding to the applied pressure from the molding material, so that between the third annular body 83 and the plunger 30, similar to the mechanical sealing, the sealing resistance corresponding to the applied pressure is temporarily generated, and the leakage of the molding material is prevented.

When the injection pressure is greater than the prescribed value, specifically, in the prescribed duration just before and after the VP switching in which the injection pressure reaches the peak pressure, the moving distance of the plunger 30 is short, so that the adverse influence on the movement of the plunger 30 is small even if the sealing resistance increases temporarily. On the other hand, the sealing resistance becomes stronger so that the semisolid light metal molding material which intervenes in the first gap δ1 escapes from being broken.

In a duration of the pressure keeping, the molding material in the injection chamber 10A is pressurized with a pressure lower than the peak pressure, so that the pressure of the molding material in the second gap δ2 is also reduced to a certain pressure, and the third annular body 83 relaxes the tightening force to return to an original shape.

After the injection of the molding material in the injection chamber 10A is completed, while the backflow preventing device 7 opens the flow path of a junction 6 and the plunger 30 moves backward, a prescribed amount of molding material in the next injection process is sent to the injection chamber 10A from the melting unit 2. The molding material is hardly compressed in the injection chamber 10A, so that the molding material on the back-end side of the injection cylinder 10 is also about to return to the open injection chamber 10A, and the pressure of the molding material in the second gap δ2 is also reduced. As a result, the third annular body 83 transforms to be expanded in the radial direction of the plunger 30 and restores the original shape.

Figure 4:
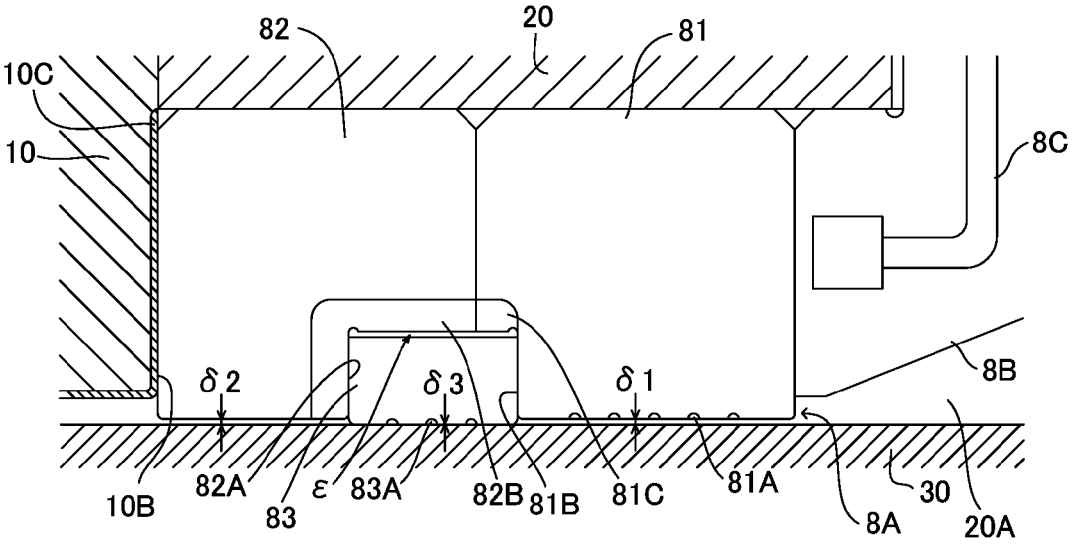
FIG. 4 is a drawing showing another embodiment of the seal mechanism of the plunger of the light metal injection molding machine of the disclosure.

FIG. 4 shows another embodiment in which the seal mechanism 8 of the disclosure is suitably applied. FIG. 4 shows the cross-section on the upper side when the seal mechanism observed from a front surface of the injection molding machine is cut vertically along the center. In FIG. 4, the same reference numerals are respectively given to the same members or equivalent members with the same function as in FIG. 2. A detailed description about the substantially same members is omitted.

The seal mechanism 8 of the embodiment shown in FIG. 4 is characterized in that the third annular body 83 is accommodated not only in the second annular body 82 but also in the first annular body 81. Specifically, a posterior internal groove 81B is formed on the injection cylinder 10 side of the inner periphery surface of the first annular body 81, and the third annular body 83 is partly accommodated in the posterior internal groove 81B. In other words, the posterior internal groove 81B of the first annular body 81 and the anterior internal groove 82A of the second annular body 82 integrate with each other to form a combined internal groove, and the combined internal groove is accommodated in the third annular body 83. The seal mechanism 8 of the embodiment shown in FIG. 4 has a sealing function and a guide function, basically without distinction with the seal mechanism 8 shown in FIG. 2 in the function.

The fourth gaps is formed between the inner periphery surface of a part of the first annular body 81 and the second annular body 82 on which the combined internal groove is arranged and the outer periphery surface of the third annular body 83. The fourth gaps allows the transformation that the entire third annular body 83 expands and shrinks, and limits the expansion to prevent the breakage of the third annular body 83. The regulation is performed so that there is no gap between the lateral surface of the posterior internal groove 81B and the lateral surface of the third annular body 83, and there is no movement in the direction of the central axis O of the injection cylinder 10. The seal mechanism 8 of the embodiment in FIG. 4 improves the workability because the third annular body 83 which requires maintenance is removed relatively easily.

In the seal mechanism 8 shown in FIG. 4, in a direction perpendicular to the posterior internal groove 81B, in other words, in the moving direction of the plunger 30, a plurality of anterior transverse holes 81C in the same shape are passing through the inner periphery surface of the first annular body 81. The posterior transverse holes 81C are arranged with the same number as the plurality of anterior transverse holes 82B which are arranged in the second annular body 82. Each posterior transverse hole 81C is placed equally on the circumference when observed from the lateral surface of the first annular body 81. And, each posterior transverse hole 81C which is placed opposite to the anterior transverse holes 82B respectively, is integrated respectively with the anterior transverse holes 82B to form a combined transverse hole respectively.

The light metal injection molding machine of the disclosure is not limited to the embodiment in the scope not departing from the technical thought of the invention, and can be transformed, replaced and supplemented though some examples have already been expressed specifically. Or else, the invention can be implemented in combination with the publicly known technology. For example, in the pressing body 8B which cools the first annular body 81, cooling elements such as a Peltier element can be used instead of arranging the flow path 8C of the cooling medium.

According to the disclosure, when an injection pressure is relatively low, a gap between the opening and the plunger is sealed mainly by the molding material in a semisolid state in the gap between the first annular body and the plunger. Because of the relatively small load receive by the seal, a leakage of the molding material prevented completely, and an increase of the sliding resistance of the plunger can be suppressed. As a result, wear of the seal is less and a loss of energy can be reduced.

When the injection pressure is greater than the prescribed value, that is, generally within a short prescribed duration just before and after the injection pressure reaches a peak pressure, an applied pressure from the molten molding material flowing into the plurality of transverse holes in the second annular body is maximized, and the third annular body tightens the plunger with the tightening force corresponding to the applied pressure. Accordingly, a sealing resistance is increased during the above prescribed duration in which a moving distance of the plunger is shorter and the load applied to the seal is the maximum. Therefore, the leakage of the molding material can be prevented properly, and an effect on the movement of the plunger can be reduced. As a result, the wear of the seal is less and the loss of energy can be reduced.

What is claimed is:

1. A light metal injection molding machine, comprising:

an injection cylinder, which has an injection chamber filled with a molding material made of a light metal;

a seal cylinder, which has an opening;

a plunger, which passes through the opening, reciprocates in the injection chamber and injects the molding material; and a seal mechanism, which prevents leakage of the molding material between the opening and the plunger, wherein the seal mechanism comprises:

a first annular body, which is arranged in the opening, forms a first gap between an inner periphery surface of the first annular body and an outer periphery surface of the plunger, and maintains a semisolid state of the molding material in the first gap;

a second annular body, which is sandwiched between the injection cylinder and the first annular body along a moving direction of the plunger to be arranged in the opening so that lateral surfaces of the first annular body and the second annular body contact with each other, and which comprises an anterior internal groove which is formed over a whole inner periphery surface of the second annular body, and a plurality of anterior transverse holes passing through the inner periphery surface of the second annular body in a direction perpendicular to the anterior internal groove; and a third annular body, at least a part of which is accommodated into the anterior internal groove transformably in a radial direction of the plunger, and which is pressurized by the molding material flowing into the anterior transverse holes to reduce diameter equally on a whole of the third annular body and tighten the plunger.

2. The light metal injection molding machine according to claim 1, wherein the seal mechanism further comprises a pressing body, which presses the first annular body to fix the first annular body, the second annular body, and the third annular body to the opening.

3. The light metal injection molding machine according to claim 2, wherein the pressing body cools the first annular body to a prescribed range of temperature, and maintains a semisolid state of the molding material.

4. The light metal injection molding machine according to claim 3, wherein the pressing body comprises a passage for flowing of a cooling medium.

5. The light metal injection molding machine according to claim 1, wherein the plurality of anterior transverse holes are the same in shape.

6. The light metal injection molding machine according to claim 1, wherein the plurality of anterior transverse holes are arranged equally on a circumference of the second annular body when observed from a lateral surface of the second annular body.

7. The light metal injection molding machine according to claim 1, wherein the second annular body forms a second gap between an inner periphery surface of the second annular body and an outer periphery surface of the plunger, and the molding material flows into the anterior transverse holes through the second gap.

8. The light metal injection molding machine according to claim 7, wherein a temperature of the molding material in the second gap is lower than a temperature of the molding material inside the injection chamber, and is higher than the temperature of the molding material in the first gap.

9. The light metal injection molding machine according to claim 1, wherein the molding material permeates between the inner periphery surface of the third annular body and the outer periphery surface of a plunger, and forms a third gap between the inner periphery surface of the third annular body and the outer periphery surface of the plunger.

10. The light metal injection molding machine according to claim 1, wherein a fourth gap is formed between the inner periphery surface of a part of the second annular body on which the anterior internal groove is arranged and the outer periphery surface of the third annular body.

11. The light metal injection molding machine according to claim 1, wherein a temperature of the molding material flowing to the anterior transverse holes is lower than a temperature of the molding material in the gap between the injection cylinder and the plunger, and is higher than a temperature of the molding material in the first gap.

12. The light metal injection molding machine according to claim 1, wherein the first annular body further comprises a posterior internal groove which is formed over a whole inner periphery surface of the first annular body, the posterior internal groove forms a combined internal groove integrated with the anterior internal groove, and the third annular body is accommodated into the combined internal groove.

13. The light metal injection molding machine according to claim 12, wherein the first annular body comprises a plurality of posterior transverse holes passing through the inner periphery surface of the first annular body in a direction perpendicular to the posterior internal groove, and the plurality of posterior transverse holes form a combined transverse hole integrated with each of the plurality of anterior transverse holes.

14. The light metal injection molding machine according to claim 12, wherein a fourth gap is formed between the inner periphery surface of a part of the first annular body and the second annular body on which the combined internal groove is arranged and the outer periphery surface of the third annular body.

* * * * *